US005879091A

United States Patent [19]

De Ambrogio et al.

[11] Patent Number: 5,879,091

[45] Date of Patent: Mar. 9, 1999

[54] IMPACT PRINTER WITH YIELDING PLATEN

[75] Inventors: Attilio De Ambrogio, Cigliano; Massimo Oberto, Aglie' ; Gianrico Scarton, Ivrea, all of Italy

[73] Assignee: Ing. C. Olivetti & C., S.p.A., Ivrea, Italy

[21] Appl. No.: 793,953

[22] PCT Filed: Jun. 28, 1996

[86] PCT No.: PCT/IT96/00135

§ 371 Date: Mar. 12, 1997

§ 102(e) Date: Mar. 12, 1997

[87] PCT Pub. No.: WO97/02954

PCT Pub. Date: Jan. 30, 1997

[30] Foreign Application Priority Data

Jul. 12, 1995 [IT] Italy ..... T09500589

[51] Int. Cl.[6] ..... B41J 11/08

[52] U.S. Cl. ..... 400/656; 400/658

[58] Field of Search ..... 400/656, 648, 400/657, 658, 652

[56] References Cited

U.S. PATENT DOCUMENTS

| | | | |
|---|---|---|---|
| 1,836,906 | 12/1931 | Degener | 400/656 |
| 2,881,893 | 4/1959 | Metzner | 400/656 |
| 4,215,946 | 8/1980 | Nakabo et al. | 400/656 |
| 4,227,819 | 10/1980 | Manriquez | 400/56 |
| 4,318,452 | 3/1982 | Reitner | 400/656 |
| 4,575,267 | 3/1986 | Brull | 400/56 |
| 4,632,577 | 12/1986 | Brull et al. | 400/56 |
| 4,940,994 | 7/1990 | Habelt et al. | 400/656 |

FOREIGN PATENT DOCUMENTS

| | | | |
|---|---|---|---|
| 195 981 | 3/1986 | European Pat. Off. . | |
| 502 212 A2 | 3/1992 | European Pat. Off. . | |
| 25 16 149 | 10/1976 | Germany . | |
| 1-304970 | 12/1989 | Japan | 400/656 |
| 3-256764 | 12/1991 | Japan | 400/656 |

OTHER PUBLICATIONS

Statutory Invention Registration, No. H338,Louie J. Lipp, Oct. 1987.

*Primary Examiner*—Edgar Burr
*Assistant Examiner*—Leslie Grohusky
*Attorney, Agent, or Firm*—Banner & Witcoff, Ltd.

[57] ABSTRACT

An impact printer (30) comprises a printhead (31) traversing along a guide for printing a line on a document (32) of thickness S, and is provided with contrast means for supporting the document (32) against the head (31) and for contrasting the impact force exerted by the latter against the document. The printhead (31) bears a spacing roller (34) which causes the contrast means to yield in order to compensate for thickness S, which varies according to the document (32), and thus maintain the distance D between the head (31) and the document (32) constant. The contrast means comprise a flexible platen (33) attached yieldingly at the ends, of length at least equal to or greater than that of the print line and having a variable section frame so that the pressure generated between the platen (33) and the roller (34) is substantially constant all along the print line.

12 Claims, 3 Drawing Sheets

PRIOR ART

IMPACT PRINTER WITH YIELDING PLATEN

FIELD OF THE INVENTION

The present invention relates to an impact printer comprising a printhead that travels along a guide for printing a line of print of determined length on a document, contrast means for supporting the document against the head and contrasting the impulse exerted by the head during printing of the line, spacing means borne by the printhead and cooperating with the contrast means for maintaining a constant distance between the head and the document along the line of print, and elastic pressure means for applying pressure between the spacing means and the contrast means.

RELATED TECHNOLOGICAL ART

A known printer of characteristics similar to those described above is represented in diagram form in FIG. 1, wherein it is labelled 10. A frame 11 of the printer 10 supports two springs 12 that act on the ends 18 of a platen 13, ideally rigid type and on which a document 14 rests. A needle printhead 16, of known type, moves in a fixed rectilinear trajectory along the document 14 for printing characters on the document 14 through the interposition of an ink ribbon not shown in the drawings, and bears a spacing roller 17, which presses the document 14 against the platen 13 during movement of the head 16. In this way, the springs 12 become deformed and thus allow the platen 13 to move with respect to the head 16 and adapt itself to thickness S of the document 14, so that the roller 17 keeps the document 14 at a constant distance D from the head 16, regardless of thickness S of the document.

A pressure P that the roller 17 exerts on the document 14 varies considerably during movement of the head 16. In fact the roller 17, when in proximity of one of the two ends 18 of the platen 13, is contrasted solely by a force corresponding to the elastic reaction of one of the springs 12, whereas, as the head 16 approaches the centre of the platen 13, as indicated by the dashed line in FIG. 1, this force tends to increase and become theoretically, assuming null flexibility of the platen 13, twice that at the ends of the platen 13 and corresponding to the yielding of both springs 12.

The pattern of P is illustrated in graphic form in FIG. 2 by a curve 19 which, for a given thickness S of the document 14, represents the variation of the pressure generated between the roller 17 and the platen 13, along an entire length L of the platen 13; the value assumed by the pressure P in proximity of the two ends 18 of the platen 13 is indicated with $P_{est}$, while the value assumed at the centre L/2 is indicated with $P_{max}$.

Variation of the pressure of the spacing roller on the document during head movement gives rise to numerous drawbacks, notably:

- the likelihood of the roller 17 making a mark on the document, especially if the latter comprises carbon copy sheets or tracing paper, by passing over it during movement of the head or during feeding of the document when a line feed is effected;
- variable printing density along the print line when the printhead is impact type, a needle printer for example. In this case, in fact, the elements of the printhead that touch the document exchange energy with the bar, and printing density may be greater at the centre of the line, where the platen contrasts the head with a pressure twice that exerted on the ends, where printing may appear faint. To the detriment of printing density, in fact, the platen tends to dynamically absorb a greater portion of the energy of the head impact elements at its ends, where it contrasts the head with a pressure markedly lower (approximately half) than at the centre of the bar.

Moreover, if a sufficient printing density is also desired in proximity of the ends of the platen and not solely at the centre, the force exerted by the springs on the ends must be increased, but this requirement conflicts with that of reducing the force in order to avoid the roller causing marks on the document at the centre of the bar.

SUMMARY OF THE INVENTION

One object of the present invention is to eliminate the drawbacks described in the foregoing, and this object is achieved by the printer of the invention, which is characterized by the fact that the pressure between the spacing means and the contrast means is substantially constant along the entire length of the print line.

According to a further characteristic of the invention, the contrast means comprise a flexible platen having its two ends resting on yielding supports and placed apart at a distance at least equal to length of the print line and, according to yet another characteristic, the value for the flexible platen of the product of the modulus of elasticity of the material from which the platen is manufactured by the moment of inertia of the section of the platen with respect to its longitudinal barycentric plane, is variable and tends to increase in the direction from the ends of the platen towards the centre.

These and other characteristics of the invention will become apparent from the description that follows, provided by way of non-exhaustive example, taken in conjunction with the accompanying drawings.

DESCRIPTION OF THE PREFERRED EMBODIMENTS

Figure 1:
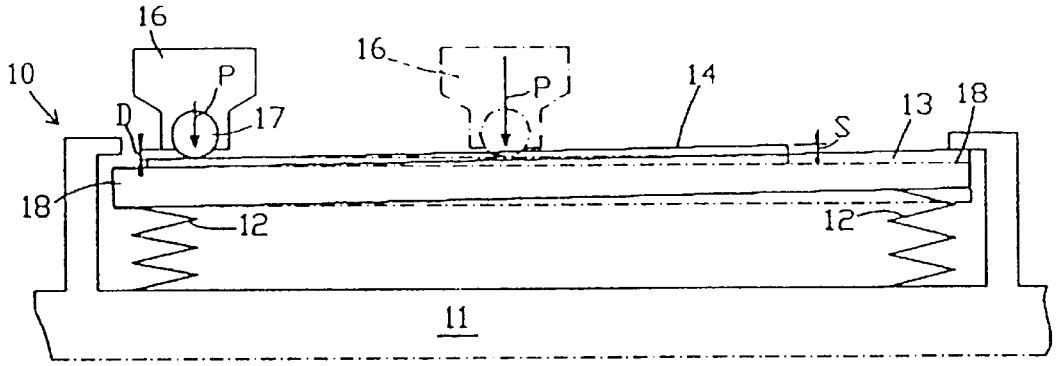
Fig. 1 PRIOR ART
FIG. 1 illustrates a schematic view of an impact printer comprising a platen manufactured according to the prior art.
Figure 2:
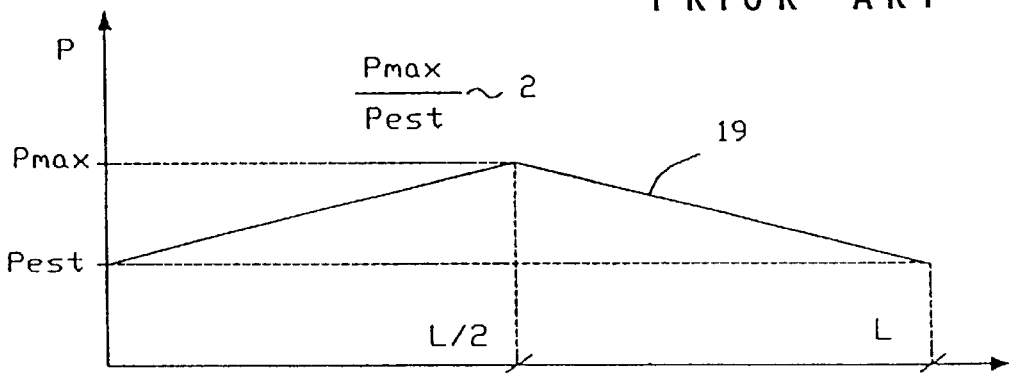
FIG. 2 illustrates the pattern of pressure between the head and the platen in the printer of FIG. 1.
Figure 3:
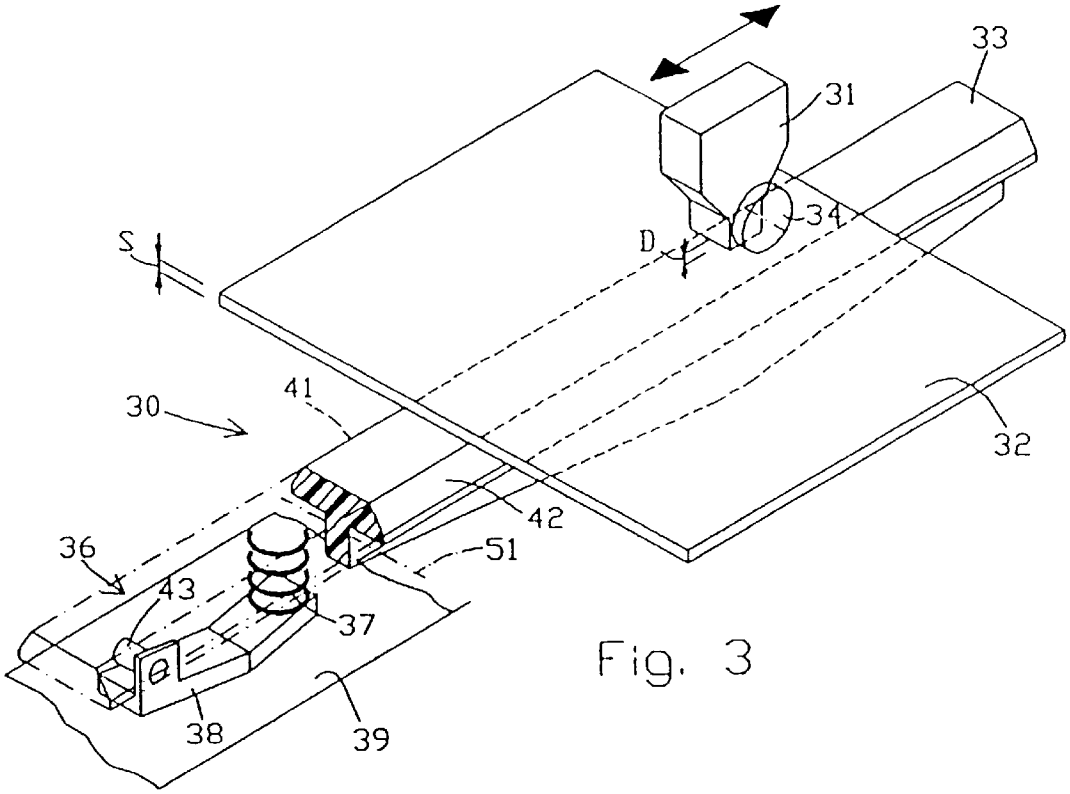
FIG. 3 illustrates in partial manner a perspective view of the printer and of the platen according to the invention.
Figure 7:
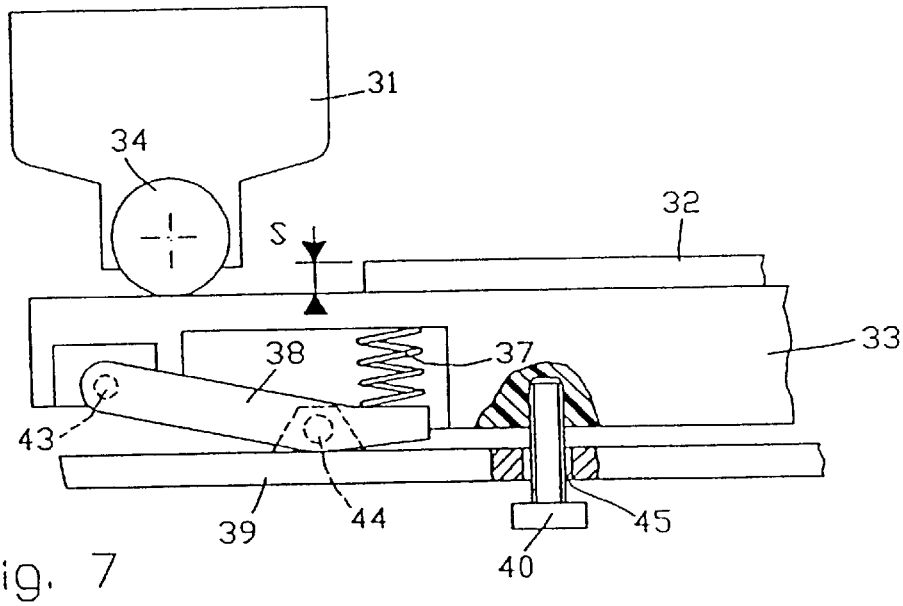
FIG. 7 illustrates a front view, showing details of some of the members of FIG. 3.

With reference to FIG. 3, a printer 30 is provided with an impact head 31, for example but not necessarily, a needle printhead, and with a platen 33, manufactured from a material having a modulus of elasticity E, on which rests a document 32 to be printed and having a thickness S. The head 31 bears a spacing roller 34 which presses on the document 32 to push it against the platen 33 and maintain it at a fixed distance D from the head 31. In turn, the platen 33 is set at its ends on yielding supports 36, one only of which is illustrated in FIG. 3, and each comprising a spring 37 and an arm 38 oscillating on a fixed frame 39 of the printer 30. As may be seen plainly in FIG. 7, the spring 37 is set between the arm 38 and the platen 33, whereas the arm 38 has one end attached pivotingly to the platen 33 by means of a pin 43.

In addition, the arm 38 is hinged in an intermediate area between its ends to the frame 39 by means of another pin 44. Thus the arm 38 is suitable for oscillating about frame 39, causing the spring 37 to become deformed, and allowing the platen 33 to move with respect to the head 34, to compensate for thickness S of the documents 32 placed between the platen 33 and the head 31. For limiting travel of the platen 33 whenever not contrasted by roller 34, an abutment element 40 is provided attached to the platen 33, which extends through a hole 45 in the frame 39 and is suitable for abutting against the latter when the head 31 is not disposed above the platen 33 and as a result the roller 34 is not pressing against it.

In addition, the platen 33 is provided with two guide areas 41 and 42 (FIG. 6), arranged along and on opposite sides of the platen itself, with the purpose of guiding passage of the document 32 under the head 31 so that it does not become jammed.

Figure 5:
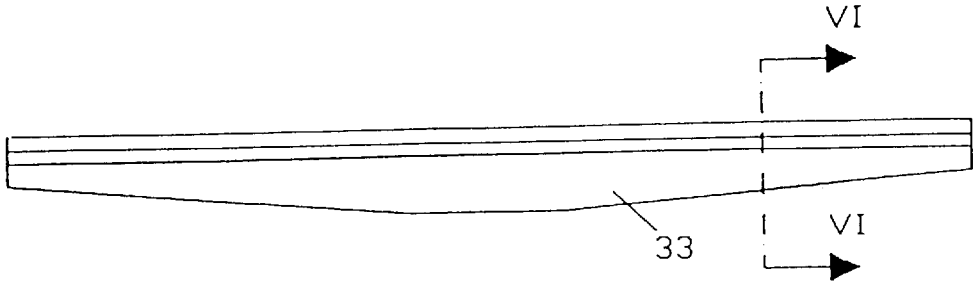
FIG. 5 illustrates a partial longitudinal view of the platen, according to a first embodiment of the invention.
Figure 6:
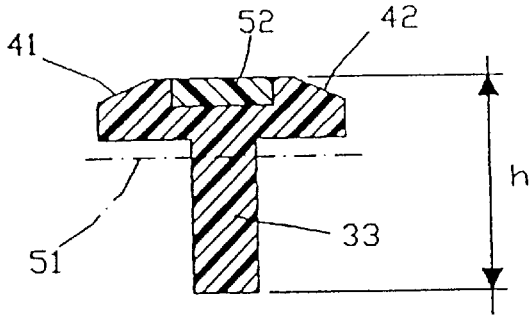
FIG. 6 illustrates a transverse section of the platen of FIG. 5.

FIGS. 5 and 6 illustrate the platen 33 in longitudinal and transverse view respectively, and show that the platen 33, according to a first embodiment of the invention, has a T section, height h of which tends to increase, in the direction from the ends of the platen 33 towards the centre. A generic section VI—VI of the platen 33, like that illustrated in FIG. 6, defines a horizontal barycentric plane 51 passing through the centre of gravity of this section.

In this embodiment, as is well known to those skilled in the sector art, the moment of inertia J of the section with respect to the plane 51 increases in the direction from the ends of the platen towards the centre, and accordingly also the product of the moment of inertia J by the modulus of elasticity E of the material from which the platen is manufactured increases from the ends towards the centre of the platen. Moreover, as is also known to those skilled in the sector art, the product of the modulus of elasticity E by the moment of inertia J mentioned before is inversely proportional to the capability of the platen 33 to bend under a determined pressure. In other words, the lower the product of E by J, the greater the flexibility of each section of the platen 33 or, to put it the other way round, the higher the product of E by J, the greater the rigidity offered.

The frame of the platen 33, according to this first embodiment, determines a pattern of the product of E by J such that different degrees of flexibility are given to the said platen, which is thus selectively deformable under the pressure exerted on it by the spacing roller 34, and becomes suitable for cooperating with the yielding means 36 so as to contrast the spacing roller 34 with a substantially constant pressure P over its entire length, when the roller 34 moves along the platen. In other words, the platen 33 bends to a different degree under the thrust of the roller 34, while during this bending action the yielding supports 36 yield, and overall behaviour of the platen 33 and of the supports 36 results in a substantially constant pattern of the pressure P all along the entire length L of the platen 33.

Figure 4:
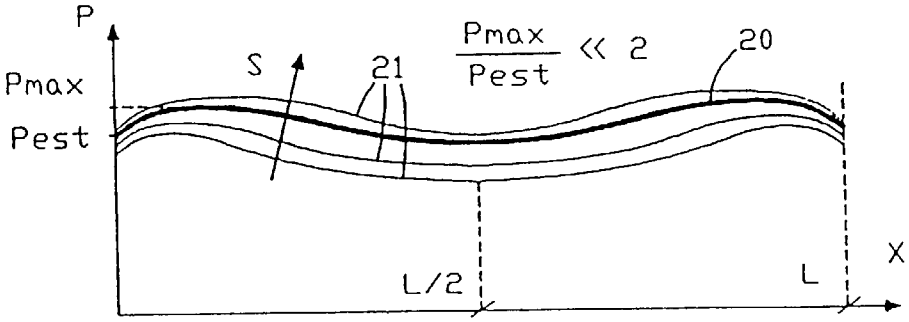
FIG. 4 illustrates the pattern of pressure between the printhead and the platen of FIG. 3.

This substantially constant behaviour of the pressure P, for a given thickness S of the document 32, is illustrated in graphic form in FIG. 4 by the curve 20 which shows how the value of P varies, along the entire length L of the platen 33, between $P_{max}$ and $P_{est}$ (where $P_{max}$ and $P_{est}$ are respectively the maximum pressure and the pressure at the ends of the platen 33), such that the following expression holds:

$$(P_{max}/P_{est})<2; \quad (1)$$

If the thickness S increases, the average pressure P also increases, but regardless of the thickness of the document (in practical applications, generally between 0.1 mm and 4 mm), the above expression (1) will always be verified.

The curve 20 is the result of experimental measurements performed by the inventors on a platen constructed as described previously, measurements obtained by moving a dynamometer along the platen and recording at each point the pressure needed to cause a determined constant yielding of that point. Also illustrated in FIG. 4, by means of the curves 21, are some patterns of the pressure P for different values of the thickness S of the document 32.

Verifications were also made of printing quality using a printer in which dimensions were selected for the yielding supports 36 and the flexible platen 33 such that a substantially constant force is generated between the platen 33 and the roller 34 along the entire print stroke of the roller 34, in the vicinity of a value 3 Nw, over a wide range of thicknesses S of documents handled, from about one tenth of a millimetre to 4 mm.

These thicknesses are those of documents, ranging from a single sheet to a banking passbook, whereas the indicative value of 3 Nw defined for the contact force between roller and document was selected both to contrast in optimum fashion the force exerted by the impact members of the head 31 on the platen 33 (a force which on average is always less than 2 Nw), avoiding excessive absorption by the platen of the energy of these impact members and the resultant reduction in printing density, and also to avoid the defect of the roller marking the document.

The platen 33 is preferably manufactured from a plastic material, but may have a mixed type frame, with metallic inserts distributed or located over the entire width of the platen. Also inserted at the top part of the platen 33 is a strip 52 of special plastic, which generally has the function of improving the surface characteristics of the platen 33 in the area that the document 32 rests on.

Figure 8:
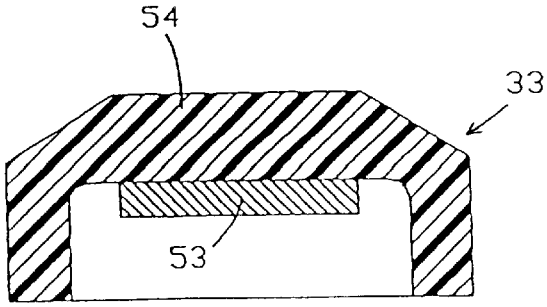
FIG. 8 illustrates a sectional view of a second embodiment of the platen according to the invention.

FIG. 8 illustrates a second embodiment of the platen, in which the platen has an upside-down U section 54, manufactured from a plastic material, and has a longitudinal profiled part 53, made, for example, of a metal or plastic sheet, arranged inside the U section. The profiled part 53 and the part 54 of plastic material together define the flexibility characteristics of the platen 33, suitable for determining a substantially constant pressure pattern.

Figure 9:
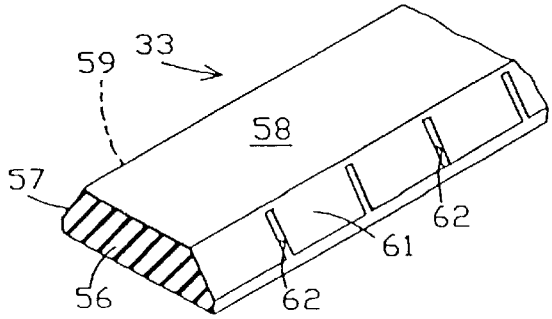
FIG. 9 illustrates a perspective view of a third embodiment of the platen according to the invention.

FIG. 9 represents a third embodiment of the platen, formed by a body 56 of yielding material, for example rubber. A profiled strip 57, made, for example, of a metal or plastic sheet, is attached on the upper part of the body 56 and defines a support plane 58 for the document 32 and two guide planes 59 and 61 for guiding the document 32 towards the plane 58 and to the outlet from the plane. The strip 57 is additionally provided with a plurality of notches 62 in the planes 59 and 61, suitable for conferring greater flexibility to the strip 57 during deformation of the platen 33.

It will be apparent that changes and/or improvements may be made to the printer of this invention, without exiting from the scope of the invention.

We claim:

1. An impact printer comprising:

an impact printhead for printing a print line of determined length (L) on a document;

a flexible platen manufactured from a material with modulus of elasticity E, said platen having two opposite ends, the distance between said opposite ends being at least equal to said length (L) of said print line, and a centre, a transversal section of said flexible platen having a moment of inertia J with respect to a longitudinal barycentric plane;

spacing means borne by said printhead and cooperating with said flexible platen for maintaining a constant distance between said printhead and a document along said print line;

resilient support means for resiliently supporting said two ends of said flexible platen, and means for maintaining a constant pattern of a pressure (P) between said spacing means and said flexible platen along said length (L) of said print line, said means including dimensioning means for said flexible platen such that a value for the product of said modulus of elasticity E by said moment of inertia J has a maximum at said centre and decreases only in both directions from said centre, in the direction of said print line towards said ends of said platen.

2. An impact printer according to claim 1, wherein said transversal section of said flexible platen has a U shape.

3. An impact printer according to claim 1, wherein said platen comprises a part manufactured with a yielding material, and a profiled strip arranged in a top portion of said platen and cooperating with said part for supporting a document against said printhead.

4. An impact printer according to claim 1, wherein said resilient support means comprise an oscillating arm and a spring, said arm having a first end, a second end opposite to said first end, and a hinging pin intermediate between said first and said second end, said first end being pivotingly attached to said platen by means of a pin, and said spring being set between said platen and said second end.

5. An impact printer according to claim 1, wherein said transversal section of said flexible platen has a T shape.

6. An impact printer according to claim 5, wherein a stem of said T shaped transversal section of said flexible platen has a height of a value decreasing in both directions from said centre towards said ends of said platen.

7. A platen for supporting a document against a spacing roller rotatively connected to an impact printhead in an impact printer, said platen having a length, two opposite ends and a centre, along the print line of the document said platen resting at said ends on resilient supports, said platen being manufactured from a material with modulus of elasticity E, a transversal section of said platen having a moment of inertia J with respect to a longitudinal barycentric plane, wherein said platen is dimensioned such that a value for a product of said modulus of elasticity E by said moment of inertia J has a maximum at said centre and decreases only along the print line in both directions from said centre toward said ends of said platen.

8. A platen according to claim 7, wherein said resilient supports comprise an oscillating arm and a spring, said arm having a first end, a second end opposite to said first end, and a hinging pin intermediate between said first and said second end, said first end being pivotingly attached to said platen by means of a pin, and said spring being set between said platen and said second end.

9. A platen according to claim 7, wherein said transversal section of said flexible platen has a U shape.

10. A platen according to claim 7, wherein said platen comprises a part manufactured with a yielding material, and a profiled strip arranged in a top portion of said platen and cooperating with said part for supporting a document against said spacing roller rotatively connected to said impact printhead.

11. A platen according to claim 7, wherein said transversal section of said flexible platen has a T shape.

12. A platen according to claim 11, wherein a stem of said T shaped transversal section of said flexible platen has a height of a value decreasing in both directions from said centre towards said ends of said platen.

* * * * *